US010584490B2

(12) United States Patent
Moudgil

(10) Patent No.: US 10,584,490 B2
(45) Date of Patent: Mar. 10, 2020

(54) LIGHT TRANSMITTING PLASTIC PANEL PROVIDING VARIABLE DAYLIGHT

(71) Applicant: Rajeev Moudgil, Gurgaon (IN)

(72) Inventor: Rajeev Moudgil, Gurgaon (IN)

( * ) Notice: Subject to any disclaimer, the term of this patent is extended or adjusted under 35 U.S.C. 154(b) by 0 days.

(21) Appl. No.: 16/300,983

(22) PCT Filed: May 4, 2017

(86) PCT No.: PCT/IB2017/052600
§ 371 (c)(1),
(2) Date: Nov. 13, 2018

(87) PCT Pub. No.: WO2017/195075
PCT Pub. Date: Nov. 16, 2017

(65) Prior Publication Data

US 2019/0338519 A1 Nov. 7, 2019

(30) Foreign Application Priority Data

May 12, 2016 (IN) ..... 201611016525

(51) Int. Cl.
*E04C 2/54* (2006.01)
*F21S 11/00* (2006.01)
(Continued)

(52) U.S. Cl.
CPC ..... *E04C 2/543* (2013.01); *E04D 3/06* (2013.01); *E04D 3/357* (2013.01); *E04F 13/18* (2013.01); *F21S 11/007* (2013.01)

(58) Field of Classification Search
CPC ..... F21S 11/007; E04C 2/543; E04D 3/357
See application file for complete search history.

(56) References Cited

U.S. PATENT DOCUMENTS 4,053,210 A * 10/1977 Michaelis ..... E04C 1/40 359/595
5,580,620 A * 12/1996 Campbell ..... E04C 2/543 428/120

(Continued)

FOREIGN PATENT DOCUMENTS

| | | | |
|---|---|---|---|
| DE | 2643602 | A1 | 3/1978 |
| FR | 2891289 | A1 | 3/2007 |
| WO | WO8200490 | A1 | 2/1982 |

*Primary Examiner* — Christopher E Mahoney
(74) *Attorney, Agent, or Firm* — King & Schickli, PLLC

(57) ABSTRACT

The present invention discloses an improved light transmitting plastic panel (100) used in buildings for providing a variable daylight either during a day or in various areas of the building. The light transmitting plastic panel (100) consists of two transparent plates (102A, 102B) and a plurality of transparent hollow cells of V-type (104A, 104B) and rhombus shaped cells (106) located in between these plates (102A, 102B). In particular, a structure of the hollow cells is a repetitive sequence of one rhombus cell (106) in between two V-type cells (104A, 104B). Further, some of the hollow cells are made opaque with a predetermined pattern. With this specific structure, the variable daylight is achieved based on a time of day. In another aspect of the invention, differential daylight is provided for different areas of the building by forming a non-continuous flow pattern of opaque hollow cells across the length of the light transmitting plastic panel (100).

11 Claims, 4 Drawing Sheets r1

(51) Int. Cl.

| | |
|---|---|
| ***E04D 3/06*** | (2006.01) |
| ***E04F 13/18*** | (2006.01) |
| ***E04D 3/35*** | (2006.01) |

(56) References Cited

U.S. PATENT DOCUMENTS

| | | | | |
|---|---|---|---|---|
| 2008/0110108 | A1 | 5/2008 | Maas et al. | |
| 2009/0100773 | A1* | 4/2009 | Flynn | B29C 67/0044 52/306 |
| 2015/0285454 | A1* | 10/2015 | Aizenberg | E06B 9/24 359/226.3 |

* cited by examiner

LIGHT TRANSMITTING PLASTIC PANEL PROVIDING VARIABLE DAYLIGHT

TECHNICAL FIELD

The present disclosure relates generally to light transmitting plastic panels used as roofs, facade and cladding in a general building and more particularly, to provide a variable daylight either during daytime or in various areas of the building.

BACKGROUND

Generally, transparent or translucent plastic panels are used in the building such as for roofs, facade and cladding, to allow significant amount of daylight to pass there through. Presently these plastic panels have linear cells with uniform color distribution. In some cases, either external horizontal cells of the plastic panels have different color (continuous) or inclined louvres in between. These types of panels allow daylight to get inside the building with a limited or unidirectional blockage.

There are numerous applications in which it is desirable to regulate light beams passing through the transparent plastic panels to provide variable daylight based on a time of day. For example, it is desirable to provide a large amount of daylight during morning and evening while attenuating the daylight during the noon time. In another aspect, it is required to provide differential daylight based on various areas of the building. As another example in this regard, there is a requirement for increased light levels in a play area compared to other areas of sports hall.

This problem is presently solved by rotating motorized or automated louvers to allow variable daylight or putting independent awnings/other material to receive various light/lux levels within the building. Therefore, there exists a need to achieve variable daylight in the building with improved efficiency, lower production cost, and ease of manufacturing.

SUMMARY

Accordingly, it is an object of the present invention to provide light transmitting plastic panels in order to overcome the disadvantages of the prior art.

There is thus provided in accordance with an embodiment of the present invention a light transmitting plastic panel consisting of two transparent plates i.e., an upper plate and a lower plate and a plurality of transparent hollow cells located in between these plates. The hollow cells between two transparent plates are combination of \'-type and rhombus shaped cells. In particular, a structure of the hollow cells is a repetitive pattern/sequence of one rhombus cell between two V-type cells. Further, at least some of the walls of hollow cells are made opaque with a predetermined pattern based on the required daylight in the building.

Thus when a light beam incidence on a surface of the light transmitting plastic panel, an amount of daylight to be transmitted into the building determined based upon an angle of incidence of the light beam, the structure of the hollow cells and a flow pattern of opaque hollow cells.

It is further object of the invention to provide differential light levels based on the specific areas of the building. This is achieved by having non-continuous opaque hollow cells across a length of the light transmitting plastic panel.

BRIEF DESCRIPTION OF THE DRAWINGS

The summary above, as well as the following detailed description of illustrative embodiments, is better understood when read in conjunction with the appended drawings. For the purpose of illustrating the present disclosure, exemplary constructions of the disclosure are shown in the drawings. However, the present disclosure is not limited to specific methods and instrumentalities disclosed herein. Moreover, those skilled in the art will understand that the drawings are not to scale. Wherever possible, like elements have been indicated by identical numbers.

Embodiments of the present disclosure will now be described, by way of example only, with reference to the following diagrams wherein.

DETAILED DESCRIPTION OF EMBODIMENTS

The light transmitting plastic panel of the present invention utilizes a specific structure of hollow cells between a pair of plates wherein some of the hollow cells are made opaque to selectively transmit light beams in accordance with the time of day. Also a flow pattern of opaque hollow cells across the length of the light transmitting plastic panel can be regulated in accordance with the need of the daylight to specific areas of the building.

The light transmitting plastic panel of the present invention can be effectively used in roofs, facade and cladding of general buildings. The present invention uses polycarbonate for the preparation of the light transmitting plastic panel, but other type of materials could also be considered for making the panel such as copolyester carbonates, polyesters, copolyesters, blends of polycarbonate, polyesters, copolyesters, acrylic, polymethyl methacrylate, polyethyl methacrylate, styrene-acrylonitrile copolymer, acrylonitrile butadiene styrene (ABS), polyamide PET, polylactic acid (PLA), TPE, TPU or any other filament/raw material etc.

The following detailed description illustrates embodiments of the present disclosure and ways in which they can be implemented. Although some modes of carrying out the present disclosure have been disclosed, those skilled in the art would recognize that other embodiments for carrying out or practicing the present disclosure are also possible.

Figure 1A:
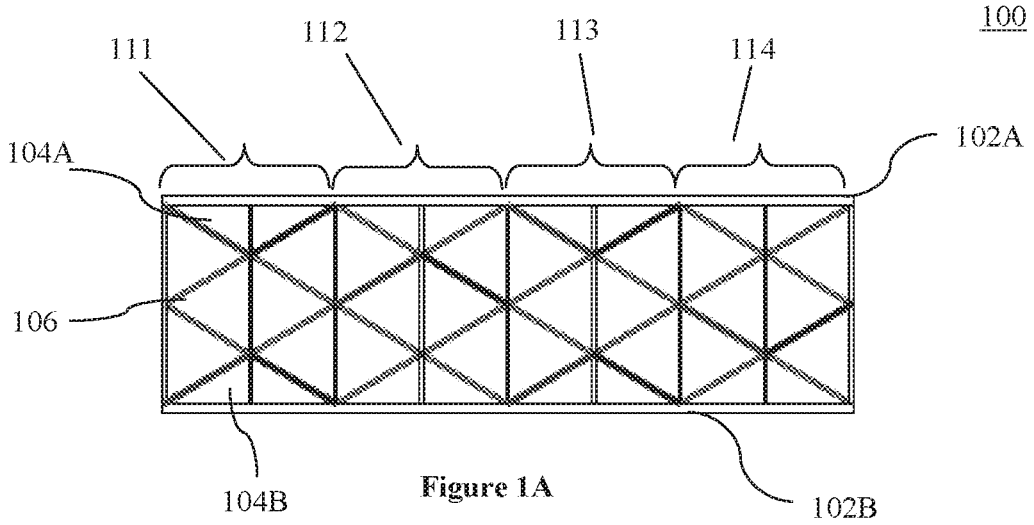
FIGS. 1A and 1B illustrate the light transmitting plastic panel in cross sectional and perspective views in accordance with first embodiment of the disclosure.
Figure 1B:
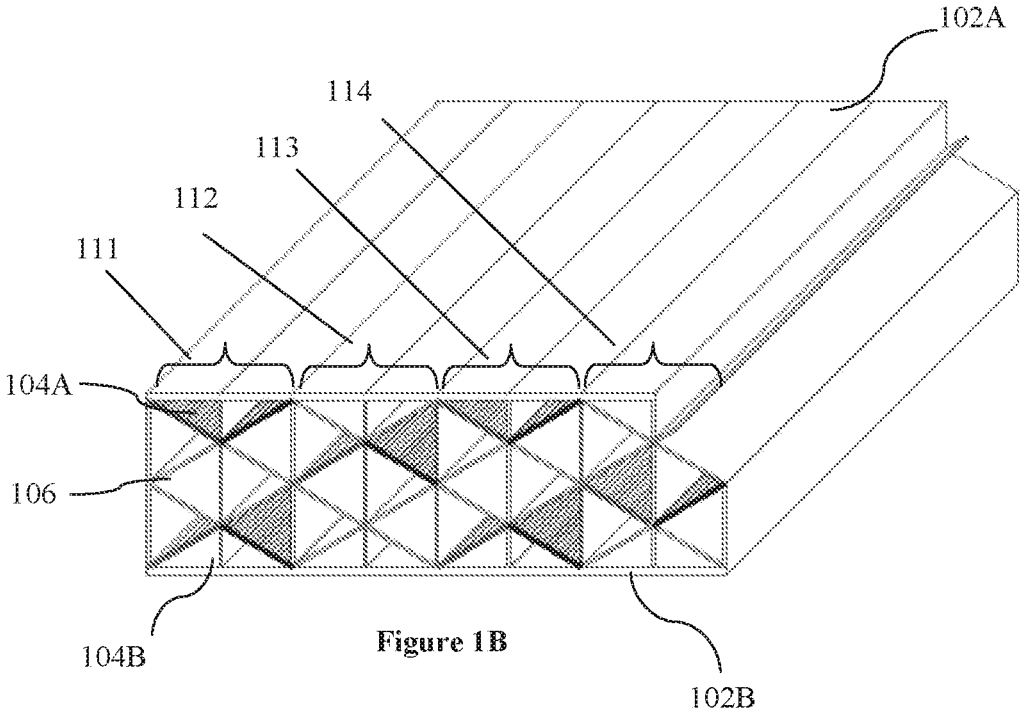

FIGS. 1A and 1B illustrate different views of the light transmitting plastic panel which includes two transparent plates, a plural of transparent hollow cells therebetween. FIG. 1A illustrates a cross sectional view of the light transmitting plastic panel and FIG. 1B illustrates a perspective view of the light transmitting plastic panel of FIG. 1A.

As shown in FIGS. 1A and 1B, the light transmitting plastic panel 100 consists an upper plate 102A and a lower plate 102B, both of which are transparent to allow light to pass therethrough. Between these two plates there is provided a plurality of transparent hollow cells of V-type and rhombus shaped cells. The specific structure used for these hollow cells is a repetitive pattern/sequence of one rhombus cell between two V-type cells. As shown, the light transmitting plastic panel 100 has one rhombus cell 106 between two V-type cells i.e., a top V-type cell 104A and a bottom V-type cell 104B. An orientation angle of sides of these hollow cells can be tailored in accordance with local conditions or daylight requirement of the building. This specific combination of V-type and rhombus shaped cells helps in channelizing the daylight because of their diagonal geometry.

As it is seen further in FIGS. 1A and 1B, some of the hollow cells of the light transmitting plastic panel 100 are made opaque to provide different transparencies to these cells, thereby achieving selective transmission of light beam into the building. The opacity of the hollow cells is achieved by adding any opaque color additives to the plastic material used in the preparation of the light transmitting plastic panel 100. Also a particular pattern being used in order to color/opaque these hollow cells could be predetermined based on the daylight essentiality of the building.

One such pattern is depicted in FIGS. 1A and 1B. For the purpose of illustration, let us split the light transmitting plastic panel 100 into different columns such as Column-A 111, Column-B 112, Column-C 113, Column-D 114 etc. Each such column contains a rhombus cell in between two V-type cells. For example, the Column-A 111 contain the rhombus cell 106 which is located between two V-type cells 102A and 102B. In this particular pattern, two V-type cells in Column-A 111 are colored and top two sides of the rhombus cell in Column-B 112 are colored. Again, two V-type cells in Column-C 113 are colored and bottom two sides of the rhombus cell in Column-D 114 are colored. The same pattern is repeated for the following hollow cells of the light transmitting plastic panel 100. The opaque/colored hollow cells in FIG. 1A is shown by dark lines whereas the same is shown in FIG. 1B by multiple thin lines drawn on the visible faces of the hollow cells.

Although FIGS. 1A and 1B illustrate the same pattern being repeated to color the hollow cells of the light transmitting plastic panel 100, it is not compulsory, however, to repeat the same pattern. Based on the demand of the daylight in the building, the hollow cells could be colored by using irregular pattern. For example, instead of repeating the same coloring pattern as used in the Column-A 111 and Column-B 112, the hollow cells in Column-C 113 and Column-D 114 can have a different color pattern.

Figure 2A:
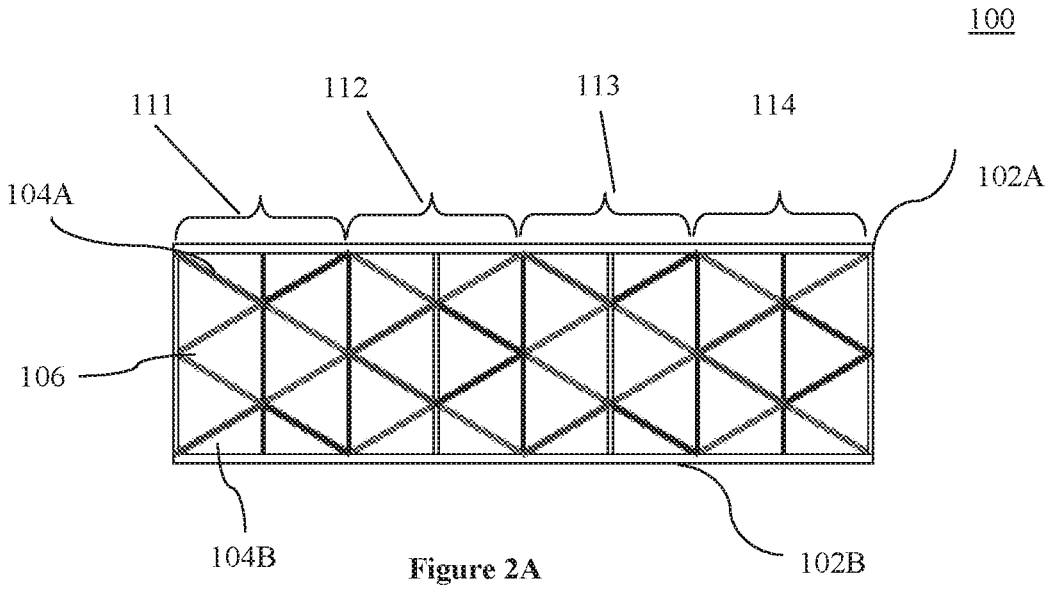
FIGS. 2A and 2B illustrate the light transmitting plastic panel in cross sectional and perspective views according to a slight variation of first embodiment.
Figure 2B:
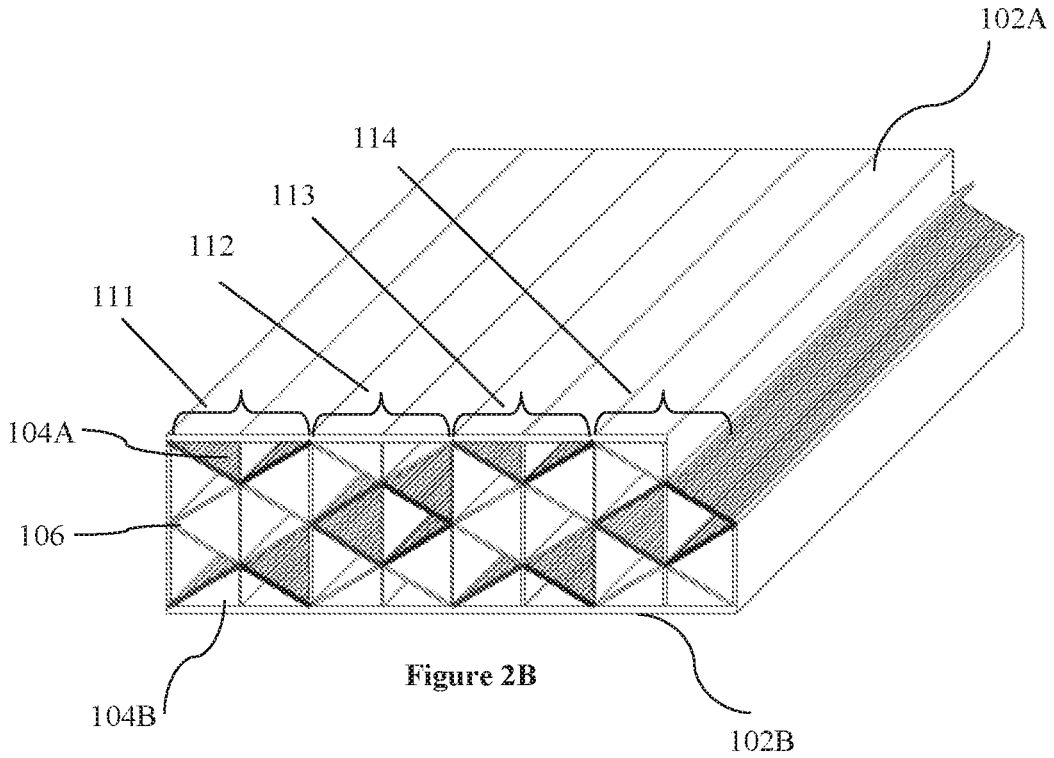

FIGS. 2A and 2B illustrate an alternative pattern of coloring the hollow cells of the light transmitting plastic panel 100. Here, two V-type cells in Column-A 111 and Column-C 113 are made opaque and all the four sides of the rhombus cells in Column-B 112 and Column-D 114 are also made opaque. This particular pattern of coloring could be repeated for the following hollow cells of the light transmitting plastic panel 100. The opaque/colored hollow cells in FIG. 2A is shown by dark lines whereas the same is shown in FIG. 2B by multiple thin lines drawn on the visible face of the hollow cells.

Figure 3A:
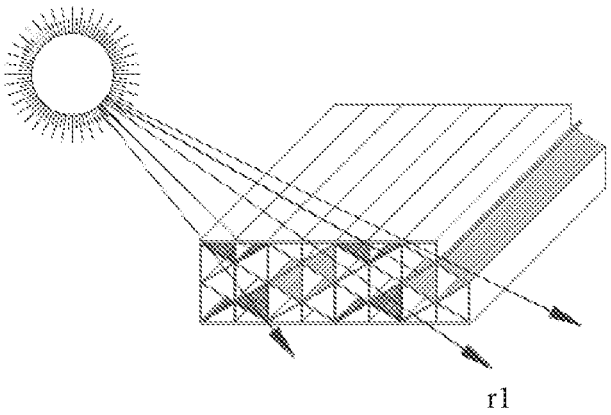
FIGS. 3A-C are functional illustrations showing the variable daylight method of the present invention.
Figure 3B:
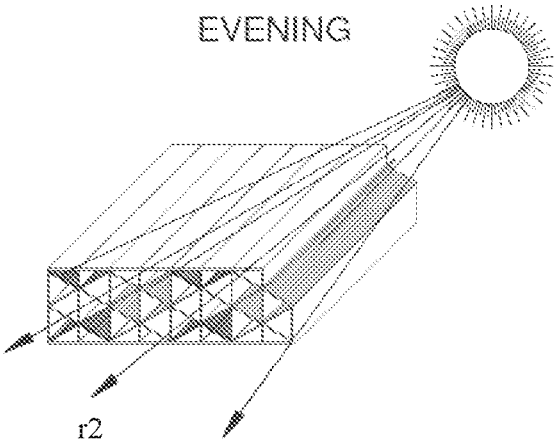
Figure 3C:
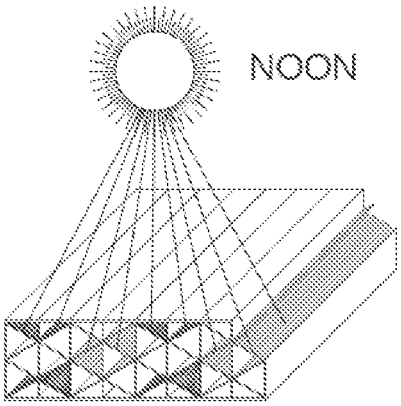

FIGS. 3A-C are functional illustrations showing the variable daylight method of the present invention. FIGS. 3A and 3B illustrate the effect of the specific structure of the light transmitting plastic panel 100 to achieve differential daylight during morning and evening time respectively whereas FIG. 3C illustrates the same during noon time. Please note that, although the reference numerals are not shown in FIGS. 3A-C for the reasons of clarity, same reference numerals as used in the previous figures are referred for describing the various parts of the light transmitting plastic panel 100 in the below explanation.

The selective transmission of the light beam depends on the angle of incidence of the light beam, the orientation angle of the hollow cells and a flow pattern of opaque hollow cells. The angle of incidence, in turn, depends upon the time of day. As shown in FIGS. 3A and 3B, the incidence light beam has an inclined angle with respect to the surface of the light transmitting plastic panel 100 in the morning and evening time. Further, as seen in FIG. 3C, the incidence light beams are perpendicular to the surface of the light transmitting plastic panel 100 in the noon. The orientation angle of the hollow cells, in particular orientation angle of the sides of the hollow cells could be customized based on the daylight requirement of the building. Also, the particular pattern of opaque hollow cells helps in regulating the daylight which is explained in detail below.

As shown in FIG. 3A, when the upper plate 102A receives the light beam, it gets directed to the hollow cells of the light transmitting plastic panel 100. Since the light beam is inclined to the upper plate 102A in the morning time, it passes through the hollow cells, according to the orientation angle of hollow cells and the pattern of the opaque hollow cells. The orientation angle of the sides of the hollow cells and the pattern of the opaque hollow cells helps in the selective transmission of the light beam inside the building. In particular, the hollow cells which are transparent permit the light beam to pass therethrough while the hollow cells which are opaque (colored) block the light beam.

In order to better understand how the transparent hollow cells allow the light beam to pass through, let us consider one of the light beam, such as a light ray 'r1' as shown in FIG. 3A. When the light ray 'r1' strikes the upper plate 102A which is transparent, it is directed to top V-type cell of Column-B 112. Since the light ray 'r1' is inclined and also sides of the hollow cells (including top V-type cell of Column-B 112) are oblique and transparent, the light beam 'b1' further gets guided towards rhombus cell of Column-C 113. As the rhombus cell of Column-C 113 is transparent, it permits the light ray 'r1' to pass through it. After passing through the rhombus cell of Column-C 113, the light ray 'r1' enters the bottom V-type cell of Column-D 114 which is also transparent, thus helping the light ray 'r1' to reach the transparent bottom plate 102B and thereby entering the interior of the building. On the other hand, the light beam is blocked by the hollow cells which are opaque (colored) when they try to pass through them.

In a similar way, a light ray 'r2' in FIG. 3B which is also inclined to the transparent upper layer 102A, passes though the oblique transparent V-type and rhombus cells and enters the building. In this way, some light beams get transmitted by forming a path through transparent hollow cells while some are blocked by the opaque hollow cells. As can be understood from FIGS. 3A and 3B, the inclined angle of the light beam, orientation angle of the hollow cells and the opacity of some of the hollow cells ensures maximum amount of daylight during morning and evening time.

Referring to FIG. 3C, the specific structure of the light transmitting plastic panel 100 allows less amount of daylight within the building during the noon time. As the light beam is perpendicular to the surface of the light transmitting plastic panel 100 in the noon, when the light beam strikes the upper plate 102A, they will be blocked by the opaque hollow cells of the light transmitting plastic panel 100. As it can be observed from FIG. 3C, at least one of the hollow cells is made opaque in each column, thus reducing the amount of daylight in the afternoon.

Figure 4A:
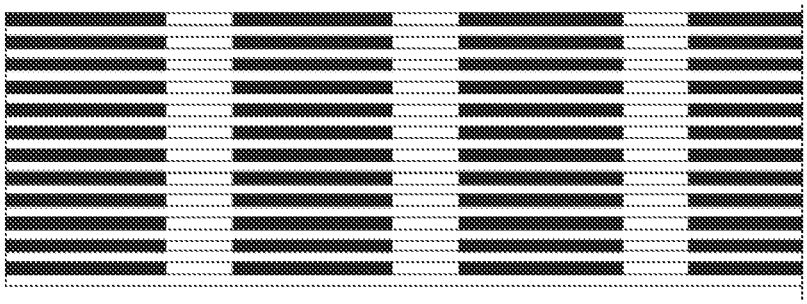
FIGS. 4A and 4B illustrate top views of the light transmitting plastic panel in accordance with second embodiment of the disclosure.
Figure 4B:
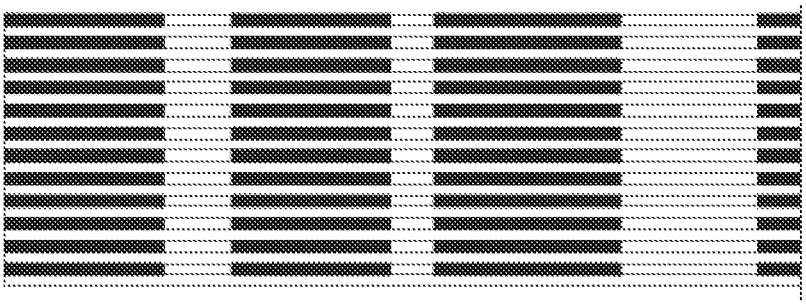

FIGS. 4A and 4B illustrate top views of the light transmitting plastic panel 100 in accordance with second embodiment of the present invention. FIG. 4A illustrates a top view of the light transmitting plastic panel 100, where the flow pattern of opaque/colored hollow cells are made symmetric.

FIG. 4B illustrates a top view of the light transmitting plastic panel 100, where the flow pattern of opaque hollow cells is asymmetric.

Although coloring the light transmitting panels in order to provide selective transmission of the light beams is well known in the prior art, the coloring is continuous across the length of the light transmitting panel. As explained earlier, there are numerous situations where it is desirable to provide differential daylight based on the areas of building. For example, there is a requirement for increased light levels in a play area compared to other areas of sports hall.

The objective of the second embodiment is to solve the above stated problems of the prior art. In this embodiment, the flow pattern of opaque hollow cells can be regulated to allow differential daylight through the length of the light transmitting plastic panel 100. As seen in FIGS. 4A and 4B, the flow pattern of opaque hollow cells is non-continuous, thereby providing differential daylight for different areas of the building. For example, when the light transmitting plastic panel 100 is used as roofing of the sports hall, the play area can be provided with increased light levels by not coloring a roof portion of the light transmitting plastic panel 100 which covers that area. Similarly, the other areas of the sports hall can be provided with decreased light levels by coloring roof portions of the light transmitting plastic panel 100 which covers those areas.

The non-continuous flow pattern of opaque hollow cells can be localized based on the needs of the differential light levels in various areas of the building. FIG. 4A illustrates one such flow pattern where the non-continuous flow pattern of opaque hollow cells are symmetric across the length of the light transmitting plastic panel 100. In FIG. 4B, the non-continuous flow pattern of opaque hollow cells is made asymmetric across the length of the light transmitting plastic panel 100, thereby achieving differential light levels for different areas of the building.

The light transmitting plastic panel 100 can be manufactured by employing co-extrusion methods which are well known in the art. Though the present invention mainly focuses on usage of color additives in order to opaque some of the oblique walls of the hollow cells of the light transmitting plastic panel 100, based on the local needs, the plastic material can also be mixed with other types of additives such as ultra-violet absorbers without limiting the scope of the invention.

While various embodiments of the present invention have been described above, it should be understood that they have been presented by way of example only, and not limitation. It will be apparent to persons skilled in the relevant art that various changes in form and detail can be made therein without departing from the spirit and scope of the invention. Thus, the breadth and scope of the present invention should not be limited by any of the above-described exemplary embodiments, but should be defined only in accordance with the following claims and their equivalents.

I claim:

1. A light transmitting plastic panel (100) for providing a variable daylight in a building comprising:

an upper plate (102A) and a lower plate (102B), wherein said upper and lower plates are substantially transparent;

a plurality of hollow cells, wherein at least some of the plurality of hollow cells are substantially transparent and include a combination of V-type (104A, 104B) and rhombus shaped cells (106) between the upper and lower plates (102A, 102B);

wherein at least some of the plurality of hollow cells are opaque to provide variable daylight by selectively transmitting a light beam through said plurality of hollow cells which are transparent and blocking the light beam which passes through said plurality of hollow cells which are opaque.

2. The light transmitting plastic panel (100) of claim 1, wherein the plurality of hollow cells are formed by a repetitive pattern of one rhombus cell (106) between two V-type cells (104A, 104B).

3. The light transmitting plastic panel (100) of claim 1, wherein the selective transmission of the light beam depends upon an angle of incidence of the light beam to a surface of the light transmitting plastic panel (100), an orientation angle of the plurality of hollow cells and a flow pattern of opaque hollow cells within said plurality of hollow cells.

4. The light transmitting plastic panel (100) of claim 3, wherein the orientation angle of the plurality of hollow cells and the flow pattern of opaque hollow cells are modified based on a required daylight within the building.

5. The light transmitting plastic panel (100) of claim 3, wherein the upper plate (102A) receives the light beam of varying angles of incidence, and directs the light beam towards the plurality of hollow cells, whereby the plurality of hollow cells allow the transmission of a large amount of daylight inside the building when the light beam is inclined to the surface of the light transmitting plastic panel (100) in the morning and evening, and allowing a less of amount of daylight when the light beam is perpendicular to the surface of the light transmitting plastic panel (100) in the noon.

6. The light transmitting plastic panel (100) of claim 1, wherein said plurality of hollow cells are made opaque by using one or more opaque colour additives to a plastic material used in a preparation of the light transmitting plastic panel (100).

7. The light transmitting plastic panel (100) of claim 6, wherein the plastic material used in the light transmitting plastic panel (100) is selected from a group comprising polycarbonates, copolyester carbonates, polyesters, copolyesters, blends of polycarbonate, polyesters, copolyesters, polymethyl methacrylate, polyethyl methacrylate, styrene-acrylonitrile copolymer, acrylonitrile butadiene styrene (ABS), polyamide polyethylene terephthalates (PET), polylactic acid (PLA), thermoplastic elastomers (TPE), thermoplastic polyurethanes (TPU).

8. The light transmitting plastic panel (100) of claim 1, wherein the light transmitting plastic panel (100) is used for roofs, facade and cladding of the building.

9. The light transmitting plastic panel (100) of claim 1, wherein the flow pattern of opaque hollow cells across the length of the light transmitting plastic panel (100) is continuous.

10. The light transmitting plastic panel (100) of claim 1, wherein the flow pattern of opaque hollow cells across the length of the light transmitting plastic panel (100) is non-continuous to provide variable daylight in various areas of the building.

11. The light transmitting plastic panel (100) of claim 1, wherein the non-continuous flow pattern of opaque hollow cells across the length of the light transmitting plastic panel (100) is either symmetric or asymmetric.

* * * * *